US011912635B2

(12) United States Patent
Pettersen et al.

(10) Patent No.: US 11,912,635 B2
(45) Date of Patent: Feb. 27, 2024

(54) EXPLOSIVE COMPOSITIONS FOR USE IN REACTIVE GROUND AND RELATED METHODS

(71) Applicant: Dyno Nobel Asia Pacific Pty Limited, Southbank (AU)

(72) Inventors: Jade Pettersen, Singleton (AU); Emma McPhail, Singleton (AU); Jeff Gore, Singleton (AU)

(73) Assignee: Dyno Nobel Asia Pacific Pty Limited (AU)

( * ) Notice: Subject to any disclaimer, the term of this patent is extended or adjusted under 35 U.S.C. 154(b) by 606 days.

(21) Appl. No.: 17/118,986

(22) Filed: Dec. 11, 2020

(65) Prior Publication Data

US 2021/0094889 A1 Apr. 1, 2021

Related U.S. Application Data

(62) Division of application No. 16/242,836, filed on Jan. 8, 2019, now Pat. No. 10,865,162.

(30) Foreign Application Priority Data

Jan. 9, 2018 (AU) ..... 2018900058

(51) Int. Cl.

| | |
|---|---|
| ***F42D 5/00*** | (2006.01) |
| ***C06B 31/28*** | (2006.01) |
| ***F42D 1/10*** | (2006.01) |
| ***C06B 21/00*** | (2006.01) |
| ***C06B 23/00*** | (2006.01) |
| ***C06B 47/14*** | (2006.01) |

(52) U.S. Cl.

CPC ..... *C06B 31/285* (2013.01); *C06B 21/0008* (2013.01); *C06B 23/006* (2013.01); *C06B 47/145* (2013.01); *F42D 1/10* (2013.01); *F42D 5/00* (2013.01)

(58) Field of Classification Search

CPC . C06B 31/285; C06B 21/0008; C06B 23/006; C06B 47/145; F42D 1/10; F42D 5/00

USPC ..... 102/313

See application file for complete search history.

(56) References Cited

U.S. PATENT DOCUMENTS 3,161,551 A 12/1964 Egly et al.
3,540,953 A 11/1970 Schulze et al.
3,886,008 A * 5/1975 Cook ..... C06B 47/00 149/43

(Continued)

FOREIGN PATENT DOCUMENTS

EA 015055 B1 4/2011
EP 0460952 12/1991

(Continued)

OTHER PUBLICATIONS

International Search Report and Written Opinion dated Apr. 19, 2019 for PCT/AU2019/050003.
Office Action dated May 7, 2020 for U.S. Appl. No. 16/242,836.

*Primary Examiner* — John Cooper
(74) *Attorney, Agent, or Firm* — Dorsey & Whitney LLP

(57) ABSTRACT

Explosive compositions for use in high temperature, reactive ground, or both, are disclosed. The explosive compositions can include an emulsion with a continuous organic fuel phase and a discontinuous oxidizer phase. The oxidizer phase can include one or more Group I or Group II nitrates.

16 Claims, 3 Drawing Sheets

(56) References Cited

U.S. PATENT DOCUMENTS

| | | | | | |
|---|---|---|---|---|---|
| 4,548,660 | A | * | 10/1985 | Ikeda | C06B 47/145 149/78 |
| 4,736,683 | A | * | 4/1988 | Bachman | C06B 31/285 102/292 |
| 5,159,153 | A | * | 10/1992 | Cranney | C06B 47/145 149/83 |
| 6,051,086 | A | | 4/2000 | Villamagna et al. | |
| 6,125,761 | A | | 10/2000 | Smith et al. | |
| 2011/0120603 | A1 | | 5/2011 | Cordova et al. | |
| 2018/0244590 | A1 | | 8/2018 | Beattie et al. | |
| 2019/0210939 | A1 | | 7/2019 | Pettersen et al. | |
| 2019/0257632 | A1 | * | 8/2019 | Nelson | F42D 1/10 |

FOREIGN PATENT DOCUMENTS

| | | | |
|---|---|---|---|
| EP | 0460952 | A2 | 12/1991 |
| EP | 0895055 | A2 | 2/1999 |
| RU | 2127239 | C1 | 3/1999 |
| RU | 2222519 | C2 | 1/2004 |
| RU | 2249236 | C2 | 3/2005 |
| RU | 2277523 | C2 | 6/2006 |
| WO | 2017035594 | | 3/2017 |

* cited by examiner

EXPLOSIVE COMPOSITIONS FOR USE IN REACTIVE GROUND AND RELATED METHODS

CROSS-REFERENCE TO RELATED APPLICATIONS

This application is a divisional of U.S. patent application Ser. No. 16/242,836 entitled EXPLOSIVE COMPOSITIONS FOR USE IN REACTIVE GROUND AND RELATED METHODS filed Jan. 8, 2019, which in turn claims priority to Australian Provisional Patent Application No. 2018900058, entitled "EXPLOSIVE COMPOSITIONS FOR US IN REACTIVE GROUND AND RELATED METHODS," filed Jan. 9, 2018, the contents of each of which are hereby incorporated herein by reference in their entireties.

TECHNICAL FIELD

The present disclosure relates generally to the field of explosives. More particularly, some embodiments of the present disclosure relate to explosive compositions for use under high temperature conditions and/or in reactive ground.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Figure 1:
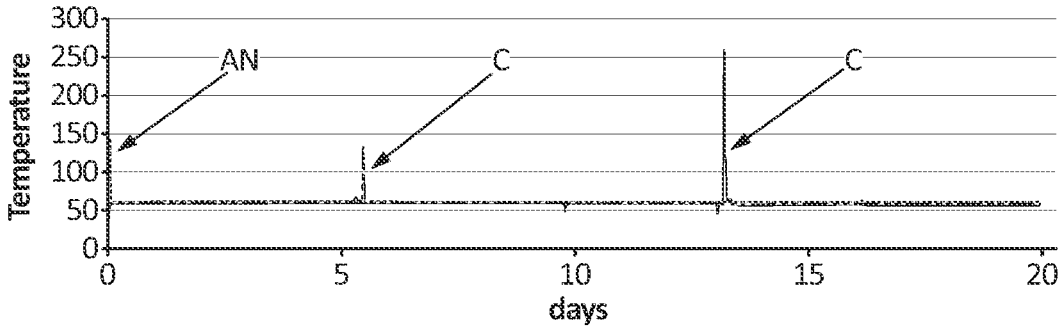
FIG. 1 is a graph showing the temperature of a first sample of reactive ground during an isothermal reactive ground test for ammonium nitrate (AN) compared to Formulation C.

Explosive compositions for use in reactive ground and/or in high temperature conditions are disclosed herein, along with related methods. Explosives are commonly used in the mining, quarrying, and excavation industries for breaking rocks and ore. Generally, a hole, referred to as a "blast hole," is drilled into a surface, such as the ground. An explosive composition may then be placed in the blast hole. Subsequently, the explosive composition may be detonated.

In some embodiments, the explosive composition is an emulsion or blend including the emulsion. In some embodiments, the emulsion comprises fuel oil as the continuous phase and an oxidizer as the discontinuous phase. For example, in some embodiments, the emulsion comprises droplets of an aqueous oxidizer solution that are dispersed in a continuous phase of fuel oil (i.e., a water-in-oil emulsion).

A potential hazard associated with explosive compositions, such as emulsion explosives, is premature detonation. Generally, explosive material is left in a blast hole for a period of time (i.e., the "sleep time") until it is fired. Stated differently, the sleep time of an explosive material is the time between loading of the material into the blast hole and intentional firing of the explosive material. Premature detonation (i.e., detonation during the intended sleep time) creates significant risks.

One potential cause of premature detonation is an elevated ground temperature. An elevated ground temperature may reduce (or supply) the activation energy needed to trigger detonation of an explosive. As used herein the term "high temperature ground" refers to ground at a temperature of 55° C. or higher.

A second potential cause of premature detonation is placement of the explosive composition in reactive ground. "Reactive ground" is ground that undergoes a spontaneous exothermic reaction when it comes in contact with nitrates, such as ammonium nitrate. Often the reaction involves the chemical oxidation of sulfides (e.g., iron sulfide or copper sulfide) by nitrates and the liberation of heat. In other words, when an explosive composition is placed in reactive ground, the sulfides within the reactive ground may react with nitrates in the explosive composition. The reaction of nitrates with sulfide-containing ground may result in an auto-catalyzed process that can, after some induction time, lead to runaway exothermic decomposition. In some instances, the resulting increase in temperature (i.e., the resulting exotherm) can lead to premature detonation. One example of reactive ground is ground that includes pyrite.

Additionally, ground to be blasted can be both high temperature ground and reactive ground.

Several strategies can be employed to prevent an exotherm and premature detonation. For example, in some embodiments, a physical barrier is placed between the explosive composition and the ground. In other or further embodiments, the reaction of the explosive composition with the reactive ground may be chemically inhibited. For example, the explosive composition may include an additive that functions as an inhibitor, such as urea, ammonia, soda ash, zinc oxide, organic amines, or combinations thereof (e.g., a urea/ammonia inhibitor).

As described in further detail below, in the embodiments disclosed herein, the explosive composition includes one or more Group I or Group II nitrates. For example, the oxidizer phase of an emulsion explosive may comprise one or more Group I or Group II nitrate salts in combination with one or more non-Group I or Group II nitrate salts, such as, for example, ammonium nitrate. The use of a Group I or Group II nitrate in the oxidizer phase may reduce the reactivity of the emulsion explosive with reactive ground and/or high temperature ground relative to other explosive compositions or emulsions that lack the Group I or Group II nitrate (or have a relatively lower amount of the Group I or Group II nitrate) in the oxidizer phase. In another example, all or a portion of one or more Group I or Group II nitrate salts may be incorporated into the explosive composition as dry particles (e.g., prill) blended with an emulsion explosive. The explosive compositions described herein may decrease the risk of undesired exotherms and/or premature detonation and, thus, allow for controlled detonation.

Examples of Group I or Group II nitrates include sodium nitrate, potassium nitrate, and calcium nitrate. In some embodiments, the Group I or Group II nitrates consist of one or more Group I nitrates.

Compositions for use in reactive ground and/or under elevated ground temperatures are described herein. In some embodiments, the explosive composition is an emulsion. For example, the emulsion may include a continuous organic fuel phase and a discontinuous oxidizer phase. In some embodiments, the continuous organic fuel phase comprises or consists of fuel oil (e.g., diesel fuel). In other or further embodiments, the continuous organic fuel phase comprises or consists of mineral oil. In some embodiments, the continuous organic fuel phase includes some other organic fuel.

The discontinuous oxidizer phase of the emulsion explosive may be an aqueous solution. Where the discontinuous oxidizer phase is or comprises an aqueous solution, the water in the discontinuous oxidizer phase may be between about 3% and about 30% of the discontinuous aqueous phase by weight. (Unless otherwise specified, all ranges disclosed herein include both endpoints.) In particular embodiments, the water in the discontinuous oxidizer phase may be about 10% to about 30% or 12% to about 25%.

As discussed above, the explosive composition may include one or more Group I or Group II nitrates in combination with one or more non-Group I or Group II nitrates. For example, in some embodiments, the Group I or Group II nitrate is present in the emulsion in an amount from about 3% to about 35% by weight. More particularly, in some embodiments, the one or more Group I or Group II nitrates are about 3% to about 35%, about 5% to about 25%, about 5% to about 18%, about 10% to about 35%, or about 10% to about 25% of the discontinuous oxidizer phase by weight.

Some embodiments include a nitrate salt that is not a Group I or Group II nitrate. For example, the discontinuous oxidizer phase of some emulsion explosives may include ammonium nitrate in addition to the one or more Group I or Group II nitrates. For example, in some embodiments, the nitrate salt that is not a Group I or Group II nitrate is ammonium nitrate, and the ratio (by weight) of ammonium nitrate to the one or more Group I or Group II nitrates is about 2:1 to about 14:1, such as from about 6:1 to 9:1 (e.g., the ratio of ammonium nitrate to sodium nitrate).

Relative to embodiments that include the same amount of nitrate salts, embodiments that include a Group I or Group II nitrate may be less prone to undesired exothermic reactions with reactive ground. Stated differently, the presence of a Group I or Group II nitrate may delay the onset and/or reduce the extent of exothermic reactivity with sulfide-containing ground.

In some embodiments, the discontinuous oxidizer phase further comprises one or more inhibitors, such as urea, ammonia, soda ash, zinc oxide, organic amines, or combinations thereof (e.g., a urea/ammonia inhibitor). The inhibitor may reduce thermal degradation of the emulsion explosive when the emulsion explosive is in contact with reactive ground. Stated differently, when the emulsion explosive is in contact with sulfide-containing ground, the inhibitor may reduce the reaction rate between the nitrate salts of the discontinuous oxidizer phase and the sulfides in the reactive ground. In some embodiments, the inhibitor is dissolved in an aqueous solution of the discontinuous oxidizer phase.

In some embodiments, the inhibitor is or comprises urea. The urea may be present at any suitable concentration. For example, in some embodiments, urea is between about 0.5% and about 35% of the discontinuous oxidizer phase by weight. More specifically, in some embodiments, the discontinuous oxidizer phase is between about 0.5% and about 10%, between about 1% and about 10%, between about 1% and about 5%, or between about 2% and about 5% urea by weight. For instance, in some embodiments, urea may be dissolved in an aqueous oxidizer phase at a concentration of between about 1% to about 5% by weight, such as about 3% by weight.

"Emulsion" as used herein encompasses both unsensitized emulsion matrix and emulsion that has been sensitized into emulsion explosive. For example, the unsensitized emulsion matrix may be transportable as a UN Class 5.1 oxidizer. Emulsion explosives comprise a sufficient amount of sensitizing agent to render the emulsion detonable with standard detonators. The emulsion may be sensitized at the blast site or even in the blast hole. It should be understood that the disclosure herein regarding either "emulsion" or "emulsion explosive" will generally apply interchangeably to the other. In some embodiments, the sensitizing agent is a chemical gassing agent. In some embodiments, the sensitizing agent comprises hollow microspheres or other solid gas-entraining agents. In some embodiments, the sensitizing agent is gas bubbles that have been mechanically introduced into the emulsion. The introduction of gas bubbles into the emulsion may decrease the density of the emulsion that is delivered to the blast hole.

Typically, explosive emulsions consist of a supersaturated discontinuous phase. If the same solution in the discontinuous phase was stored in a beaker under standard conditions, it would readily crystallize. However, the structure of emulsions reduces the rate crystallization of the supersaturated discontinuous phase. This is due to the emulsifiers creating a curved surface which results in an increase in pressure within the droplet, thereby stabilizing the supersaturated solution. This pressure increase is called the Laplace pressure. The resulting unsensitized emulsion is manufactured above the critical density which means it will fail to detonate at full order at that density. As a result, the unsensitized emulsion will pass the Series 8 UN testing and be classified as an UN Class 5.1 oxidizer. Reducing the density of the emulsion below the critical density enables the product to be reliably detonatable.

Methods of using the explosive compositions described herein are also disclosed. For example, an emulsion explosive described herein can be used to blast in reactive ground and/or ground at an elevated temperature.

For instance, one method of blasting in reactive ground includes the step of placing the emulsion explosive in reactive ground. For instance, the emulsion explosive may be loaded into a blast hole drilled within reactive ground.

The reactive ground may include any minerals that typically react with one or more nitrate salts to produce an exothermic reaction. For instance, in some embodiments, the reactive ground includes one or more sulfides. More particularly, some reactive ground includes an iron sulfide, such as iron pyrite. Ground can be identified as reactive ground by performing the isothermal reactive ground test of the Australian Explosives Industry and Safety Group Inc. (see Australian Explosives Industry and Safety Group Inc., Code of Practice: Elevated Temperature and Reaction Ground, March 2017).

When placed in reactive ground, the temperature of the emulsion explosive may not significantly change (e.g., less than 5° C., less than 3° C., less than 2° C., or less than 1.5° C.) from the temperature of the reactive ground due to exothermic reaction(s) with the reactive ground. In other words, the emulsion explosive may be placed in reactive ground and then allowed to sleep for some period of time prior to detonation. A "reactive exotherm" is defined as an increase in temperature of at least 2° C. above the background temperature in the temperature/time trace for a particular sample, where the increase in temperature shows a return to the background temperature when the reaction is completed. Such reactions may be accompanied by visible signs, such as bubbling and/or the generation of brown nitrogen oxides.

In some embodiments, no runaway exothermic reaction occurs during the sleep time for the emulsion explosive. In other words, the emulsion explosive does not experience a significant change of temperature due to an exothermic reaction with the reactive ground. In some embodiments, no (or substantially no) exotherm is produced, even when the emulsion explosive is left within reactive ground at elevated temperatures, such as reactive ground that is at elevated temperatures due to geothermal activity. In some embodiments, the reactive ground into which the emulsion explosive is placed has a temperature of greater than 55° C., greater than 65° C., greater than 75° C., greater than 100° C., greater than 125° C., greater than 150° C., greater than 160° C., and/or greater than 180° C.

More particularly, some methods of blasting in reactive ground involve the step of letting the emulsion explosive sleep for at least one day, at least two days, at least two weeks, at least one month, at least two months, or at least three months at an average ground temperature of 55° C. or more. Some methods of blasting in reactive ground may additionally or alternatively include the step of letting the emulsion explosive sleep for at least 12 hours at an average ground temperature of greater than or equal to 150° C. or greater than or equal to 180° C. For example, the emulsion explosive may sleep for some period of time in reactive ground at a temperature of between 150° C. and 200° C. without provoking a runaway exothermic reaction that significantly changes the temperature of the emulsion explosive. The avoidance of such a runaway exothermic reaction may prevent or reduce the risk of premature detonation.

Without wishing to be bound by theory, the combination of a Group I or Group II nitrate salt and urea in the discontinuous oxidizer phase may synergistically delay or otherwise slow a runaway exothermic reaction of the nitrate salt(s) of the oxidizer phase with the reactive ground. Stated differently, for embodiments that include both a Group I or Group II nitrate and urea, the increase in delay time until a significant exotherm develops may be greater than the additive delay from a Group I or Group II nitrate alone and urea alone.

After the emulsion explosive has been placed in the reactive ground, the emulsion explosive may be detonated at the desired time. For example, in some embodiments, the emulsion explosive may be detonated after the emulsion explosive has been allowed to sleep for a period of greater than 3 hours, 5 hours, 12 hours, 24 hours, 2 days, one week, two weeks, at least one month, at least two months, or at least three months.

EXAMPLES

Example 1—Reactivity of Reactive Ground with Formulations Containing Various Amounts of Sodium Nitrate The reactivity of samples from highly reactive ground obtained from an underground copper/gold mine were tested per the isothermal reactive ground test of the Australian Explosives Industry and Safety Group Inc. (see Australian Explosives Industry and Safety Group Inc., Code of Practice: Elevated Temperature and Reaction Ground, March 2017), but modified for long-term testing. During long-term testing, the samples dry out when subjected to elevated temperatures over extended periods of time. Therefore, 1 mL of water was added every 3 to 4 days to each sample. Regarding the samples, sulfide-rich samples from the mine were initially crushed to a fine powder. Each sample was then mixed with Formulation A, Formulation B, Formulation C, or ammonium nitrate (AN) (see Table 1 below). The values listed in Table 1 show the relative amounts of each component on a weight per weight basis.

TABLE 1

Compositions of Formulations A, B, and C, and AN.

| Formulation | A | B | C | AN |
|---|---|---|---|---|
| ammonium nitrate | 62 | 67 | 76 | 100 |
| sodium nitrate | 14 | 9 | 0 | 0 |
| urea | 3 | 3 | 3 | 0 |
| sodium thiocyanate | 0.3 | 0.3 | 0.3 | 0 |
| water | 15 | 15 | 15 | 0 |
| #2 fuel oil | 6 | 6 | 6 | 0 |

Figure 2:
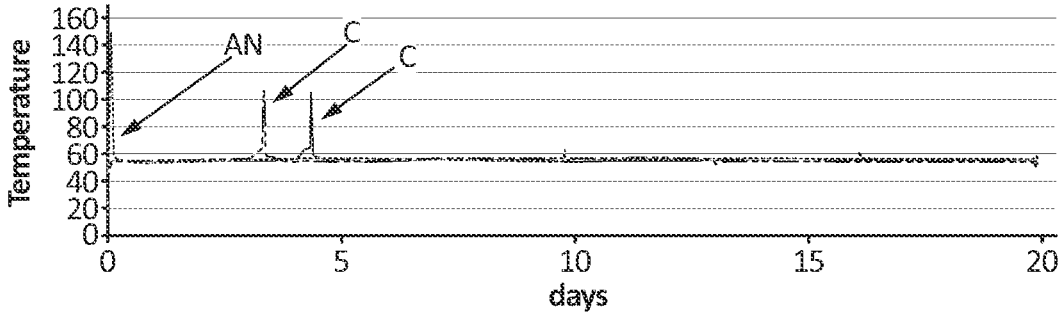
FIG. 2 is a graph showing the temperature of a second sample of reactive ground during an isothermal reactive ground test for AN compared to Formulation C.
Figure 3:
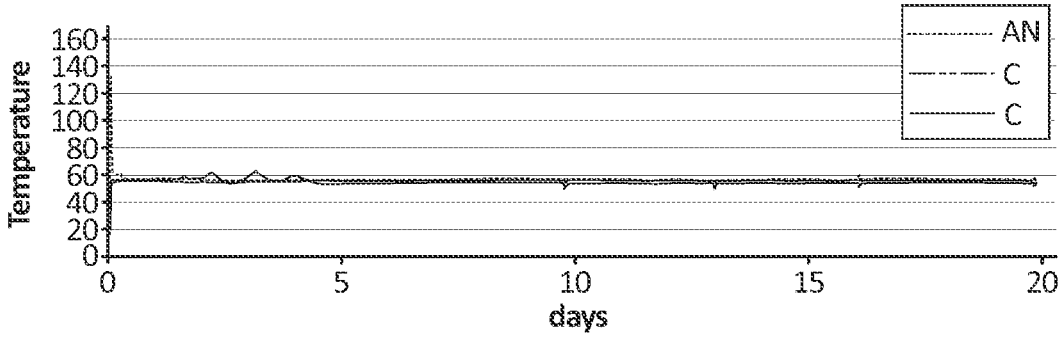
FIG. 3 is a graph showing the temperature of a third sample of reactive ground during an isothermal reactive ground test for AN compared to Formulation C.
Figure 4:
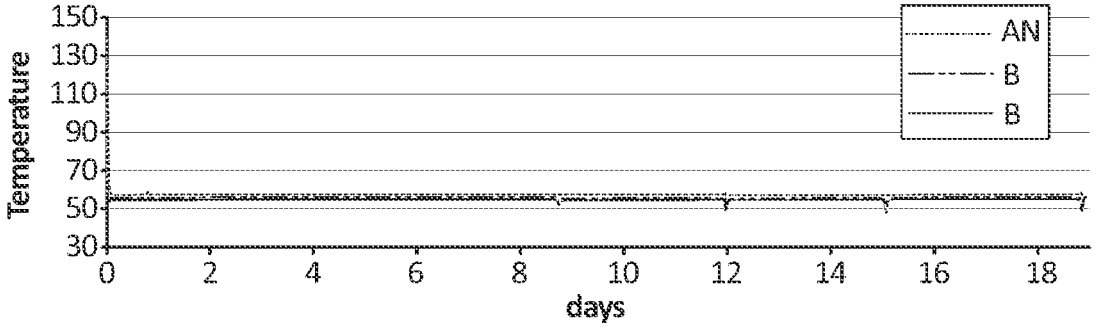
FIG. 4 is a graph showing the temperature of the first sample of reactive ground during an isothermal reactive ground test for AN compared to Formulation B.
Figure 5:
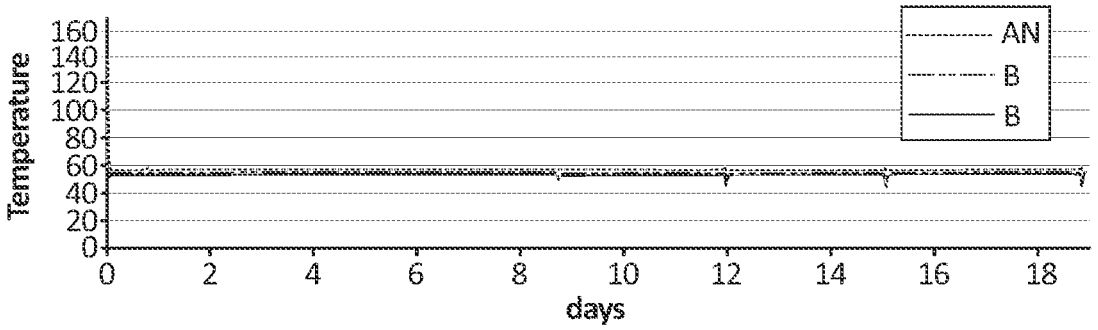
FIG. 5 is a graph showing the temperature of the second sample of reactive ground during an isothermal reactive ground test for AN compared to Formulation B.
Figure 6:
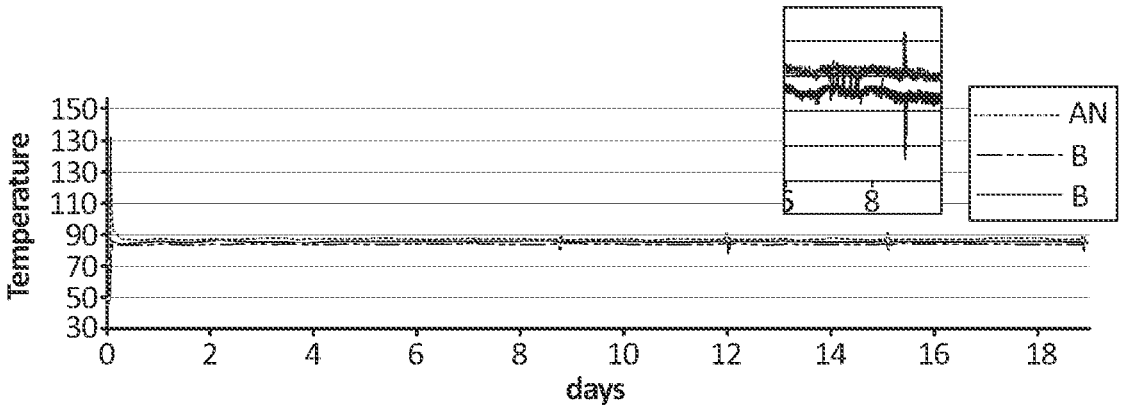
FIG. 6 is a graph showing the temperature of the third sample of reactive ground during an isothermal reactive ground test for AN compared to Formulation B.

Each mixture was then heated to and kept at 55° C. while monitoring for exothermic reactions using thermocouples that continuously log the temperature. All reactions were monitored for at least 15 days. For instance, the reactive ground samples tested with Formulation B were monitored for 19 days, and the reactive ground samples tested with Formulation A were monitored for more than 110 days. Data from the experiments are shown in FIGS. 1-6 and Table 2. More particularly, FIG. 1 shows temperature changes for a first reactive ground sample (Sample 1) that had been treated with AN and Formulation C. FIGS. 2 and 3 provide analogous graphs for a second sample (Sample 2; FIG. 2) and a third sample (Sample 3; FIG. 3) that had been similarly tested. FIGS. 4-6 show temperature changes for Sample 1 (FIG. 4), Sample 2 (FIG. 5), and Sample 3 (FIG. 6), where each sample had been tested with AN and Formulation B. Tests with Formulation A (not shown) did not result in a substantial exotherm even after more than 110 days of monitoring.

TABLE 2

Results for Isothermal Reactive Ground Test

| Reactive Ground Composition | Product | Max Temp (° C.) | Time to Max Exotherm Peak (D:HH:MM) | Average Temp (° C.) | Change in Temperature (° C.) |
|---|---|---|---|---|---|
| Sample 1 | AN | 144.4 | 0:00:32 | 56.8 | 87.6 |
| Sample 1 | Formulation C | 130.3 | 5:11:07 | 56.1 | 74.2 |
| Sample 1 | Formulation C | 258.7 | 13:04:17 | 55.7 | 203.0 |
| Sample 2 | AN | 148.5 | 0:00:40 | 55.6 | 92.9 |
| Sample 2 | Formulation C | 105.0 | 3:07:35 | 55.6 | 49.4 |
| Sample 2 | Formulation C | 101.9 | 4:07:55 | 55.5 | 46.4 |
| Sample 3 | AN | 134.8 | 0:00:33 | 56.1 | 78.7 |
| Sample 3 | Formulation C | 61.4 | 2:03:54 | 55.5 | 5.9 |

TABLE 2-continued

Results for Isothermal Reactive Ground Test

| Reactive Ground Composition | Product | Max Temp (° C.) | Time to Max Exotherm Peak (D:HH:MM) | Average Temp (° C.) | Change in Temperature (° C.) |
|---|---|---|---|---|---|
| Sample 3 | Formulation C | 62.6 | 3:03:11 | 54.8 | 7.8 |
| Sample 1 | AN | 137.5 | 0:00:38 | 56.7 | 80.8 |
| Sample 1 | Formulation B | 56.4 | | 55.8 | 0.6 |
| Sample 1 | Formulation B | 56.3 | | 55.7 | 0.6 |
| Sample 2 | AN | 143.5 | 0:00:39 | 56.0 | 87.5 |
| Sample 2 | Formulation B | 56.3 | | 55.9 | 0.4 |
| Sample 2 | Formulation B | 56.1 | | 55.6 | 0.5 |
| Sample 3 | AN | 123.0 | 0:00:51 | 56.2 | 66.8 |
| Sample 3 | Formulation B | 56.8 | 7:01:26 | 54.9 | 1.9 |
| Sample 3 | Formulation B | 56.7 | 7:03:47 | 55.0 | 1.7 |
| Sample 1 | Formulation A | ~55 | | ~55 | <1.5 |
| Sample 2 | Formulation A | ~55 | | ~55 | <1.5 |

Without being bound to any particular theory, it is believed that Group I or Group II nitrates may delay or slow the exothermic reaction of nitrates with reactive species (e.g., sulfides) in the reactive ground. It is also believed that the use of an inhibitor, such as urea, in combination with one or more Group I or Group II nitrates synergistically delays and/or reduces such exothermic reaction(s).

Example 2—Reactivity of Reactive Ground with Various Nitrate Salts

The reactivity of a known reactive ground sample (Sample 4) was tested per the isothermal reactive ground test of the Australian Explosives Industry and Safety Group Inc. More particularly, the sample was separately mixed with AN prill, calcium nitrate prill, or sodium nitrate prill.

Figure 7:
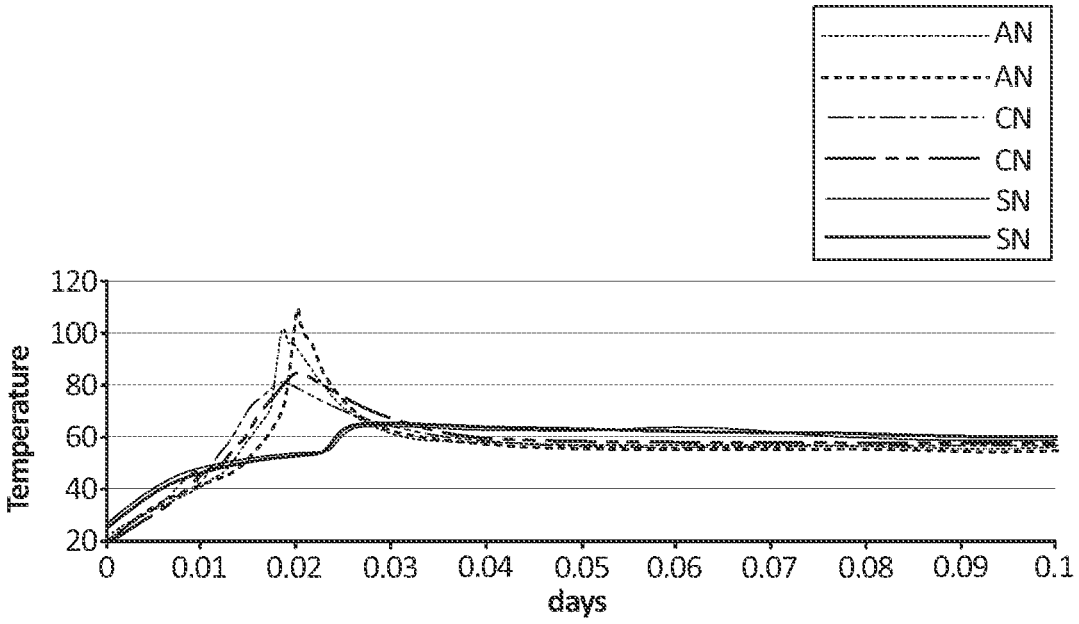
FIG. 7 is a graph showing the temperature of a fourth sample of reactive ground during separate isothermal reactive ground tests for AN, calcium nitrate (CN), and sodium nitrate (SN).

Each mixture was then heated to and kept at 55° C. and monitored for exothermic reactions using thermocouples that continuously logged the temperature. The resulting data are shown in FIG. 7 and Table 3.

TABLE 3

Results for Isothermal Reactive Ground Test Based on Various Nitrate Salts

| Reactive Ground Composition | Material Tested | Max Temp (° C.) | Time to Max Exotherm Peak (D:HH:MM) | Average Temp (° C.) | Change in Temperature |
|---|---|---|---|---|---|
| Sample 4 | Ammonium Nitrate | 100.3 | 0:00:27 | 55.3 | 45.0 |
| Sample 4 | Ammonium Nitrate | 108.8 | 0:00:29 | 55.9 | 52.9 |
| Sample 4 | Calcium Nitrate | 80.3 | 0:00:26 | 55.8 | 24.5 |
| Sample 4 | Calcium Nitrate | 83.7 | 0:00:29 | 55.9 | 27.8 |

TABLE 3-continued

Results for Isothermal Reactive Ground Test Based on Various Nitrate Salts

| Reactive Ground Composition | Material Tested | Max Temp (° C.) | Time to Max Exotherm Peak (D:HH:MM) | Average Temp (° C.) | Change in Temperature |
|---|---|---|---|---|---|
| Sample 4 | Sodium Nitrate | 65.0 | 0:00:42 | 54.7 | 10.3 |
| Sample 4 | Sodium Nitrate | 65.5 | 0:00:41 | 55.2 | 10.3 |

As can be seen in FIG. 7 and Table 3, the ammonium nitrate and calcium nitrate mixtures had a similar elapsed time for the exotherm peak, although the maximum temperature for the calcium nitrate mixtures was less than that for the ammonium nitrate mixtures. Surprisingly, and in contrast with the ammonium nitrate and calcium nitrate mixtures, the time to the exotherm peak for the sodium nitrate mixtures was significantly longer than for the ammonium nitrate and calcium nitrate mixtures. The change in temperature for the sodium nitrate mixtures was also lower than the change in temperature for the ammonium nitrate mixtures or calcium nitrate mixtures.

Example 3—Inhibition of Reactive Ground with Formulations D and E

The inhibition of a reactive ground sample (Sample 5) was tested per the isothermal reactive ground test of the Australian Explosives Industry and Safety Group Inc. More specifically, the reactive ground sample was mixed with AN, Formulation D or Formulation E (see Table 5 below). The values listed in Table 4 show the relative amounts of each component on a weight per weight basis.

TABLE 4

Composition of Nitrate Salt Formulations

| Material/Formulation | AN | D | E |
|---|---|---|---|
| ammonium nitrate | 100 | 68.6 | 59.2 |
| sodium nitrate | 0 | 0 | 8.5 |
| urea | 0 | 14.1 | 14.1 |
| water | 0 | 11.3 | 12.2 |
| #2 fuel oil | 0 | 6 | 6 |

Figure 8:
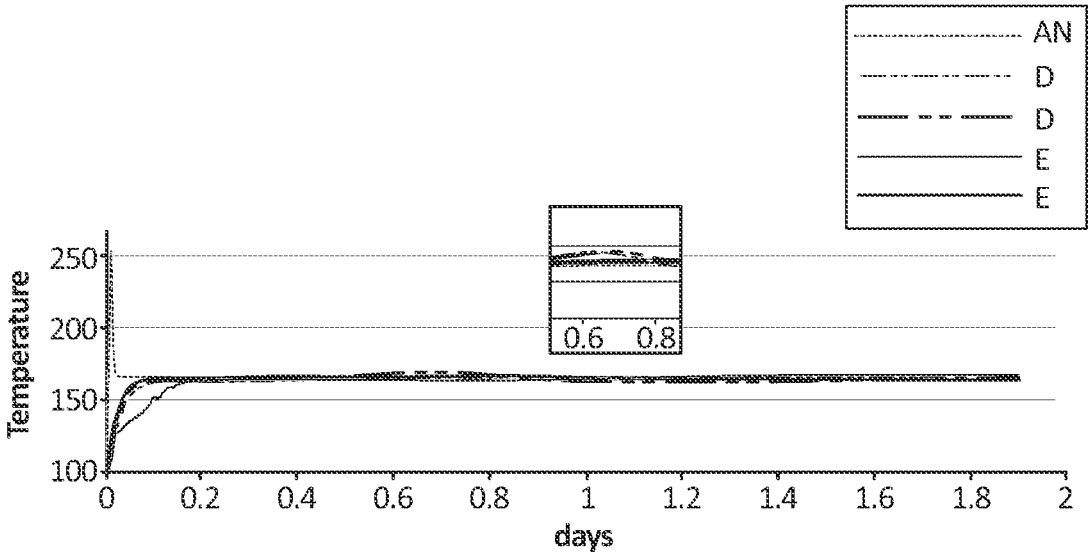
FIG. 8 is a graph showing the temperature of a fifth sample of reactive ground during separate isothermal reactive ground tests for AN and Formulations D and E.

The mixture was then heated to and kept at 165° C. and monitored for exothermic reactions using thermocouples that continuously log the temperature. The resulting data are shown in FIG. 8 and Table 5.

TABLE 5

Comparison of Inhibited Formulations without Sodium Nitrate (Formulation D) and with Sodium Nitrate (Formulation E)

| Ground Composition | Material Tested | Max Temp (° C.) | Time to Max Exotherm Peak (D:HH:MM) | Average Temp (° C.) | Change in Temperature |
|---|---|---|---|---|---|
| Sample 5 | AN | 256.1 | 0:00:07 | 164.6 | 91.5 |
| Sample 5 | Formulation D | 168.3 | 0:15:20 | 164.5 | 3.8 |

TABLE 5-continued

| Comparison of Inhibited Formulations without Sodium Nitrate (Formulation D) and with Sodium Nitrate (Formulation E) | | | | | |
|---|---|---|---|---|---|
| Ground Composition | Material Tested | Max Temp (° C.) | Time to Max Exotherm Peak (D:HH:MM) | Average Temp (° C.) | Change in Temperature |
| Sample 5 | Formulation D | 168.4 | 0:15:49 | 164.9 | 3.5 |
| Sample 5 | Formulation E | 166.6 | | 165.5 | 1.1 |
| Sample 5 | Formulation E | 166.3 | | 165.2 | 1.1 |

As can be seen in Table 5, the composition that includes sodium nitrate is less prone to an exotherm under relatively high temperature (~165° C.) conditions.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

As the following claims reflect, inventive aspects lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. It will be apparent to those having skill in the art that changes may be made to the details of the above-described embodiments without departing from the underlying principles of the present disclosure.

In this specification, unless the context clearly indicates otherwise, the term "comprising" has the non-exclusive meaning of the word, in the sense of "including at least" rather than the exclusive meaning in the sense of "consisting only of". The same applies with corresponding grammatical changes to other forms of the word such as "comprise", "comprises" and so on.

Any discussion of prior art information in this specification is not to be taken as any form of acknowledgement that that prior art information would be considered common general knowledge by a person of ordinary skill in the art.

We claim:

1. An explosive composition comprising an emulsion comprising:

a continuous organic phase comprising fuel oil;

a discontinuous oxidizer phase comprising:

urea, wherein the urea is about 0.5% to about 35% of the discontinuous oxidizer phase by weight;

a non-Group I or Group II nitrate; and one or more Group I or Group II nitrates, wherein the Group I or Group II nitrates are about 3% to about 35% of the discontinuous oxidizer phase by weight, wherein a ratio of the non-Group I or Group II nitrate to the one or more Group I or Group II nitrates is 6:1 to 9:1 by weight, and wherein the emulsion has a sleep time of at least 3 hours in contact with high temperature ground, reactive ground, or both.

2. The explosive composition of claim 1, wherein water in the discontinuous oxidizer phase is between 10% and 30% of the discontinuous oxidizer phase by weight.

3. The explosive composition of claim 1, wherein the urea is about 1% to about 25% of the discontinuous oxidizer phase by weight.

4. The explosive composition of claim 1, wherein the one or more Group I or Group II nitrates are about 5% to about 25% of the discontinuous oxidizer phase by weight.

5. The explosive composition of claim 1, wherein the one or more Group I or Group II nitrates are about 10% to about 35% of the discontinuous oxidizer phase by weight.

6. The explosive composition of claim 1, wherein the emulsion is at least 30% of the explosive composition by weight.

7. The explosive composition of claim 1, wherein the one or more Group I or Group II nitrates comprise sodium nitrate, potassium nitrate, calcium nitrate, or combinations thereof.

8. The explosive composition of claim 1, wherein the emulsion further comprises a sensitizer.

9. A method of forming a blend, the method comprising:

mixing a slurry comprising ammonium nitrate and fuel oil with an emulsion, the emulsion comprising:

a continuous organic phase comprising fuel oil; and a discontinuous oxidizer phase comprising:

urea, wherein the urea is about 0.5% to about 35% of the discontinuous oxidizer phase by weight;

a non-Group I or Group 11 nitrate; and one or more Group I or Group II nitrates, wherein the one or more Group I or Group II nitrates are about 3% to about 35% of the discontinuous oxidizer phase by weight, wherein a ratio of the non-Group I or Group II nitrate to the one or more Group I or Group II nitrates is 6:1 to 9:1 by weight, and wherein the blend has a sleep time of at least 3 hours in contact with high temperature ground, reactive ground, or both.

10. The method of claim 9, wherein the emulsion is at least 30% of the blend by weight.

11. The method of claim 9, wherein water in the discontinuous oxidizer phase is between 10% and 30% of the discontinuous oxidizer phase by weight.

12. The method of claim 9, wherein the urea is about 1% to about 25% of the discontinuous oxidizer phase by weight.

13. The method of claim 9, wherein the one or more Group I or Group II nitrates are about 5% to about 25% of the discontinuous oxidizer phase by weight.

14. The method of claim 9, wherein the one or more Group I or Group II nitrates are about 10% to about 35% of the discontinuous oxidizer phase by weight.

15. The method of claim 9, wherein the one or more Group I or Group II nitrates comprise sodium nitrate, potassium nitrate, calcium nitrate, or combinations thereof.

16. The method of claim 9, wherein the emulsion further comprises a sensitizer.

* * * * *